US009364768B2

(12) United States Patent
Williams

(10) Patent No.: US 9,364,768 B2
(45) **Date of Patent: *Jun. 14, 2016**

(54) FLYING DISK WITH REMOVABLE TRAMPOLINE PORTION

(71) Applicant: OgoSport, LLC, Brooklyn, NY (US)

(72) Inventor: Kevin Williams, Sprakers, NY (US)

(73) Assignee: Ogosport LLC, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/559,281

(22) Filed: Dec. 3, 2014

(65) Prior Publication Data

US 2015/0087197 A1 Mar. 26, 2015

Related U.S. Application Data

(63) Continuation of application No. 13/762,008, filed on Feb. 7, 2013, now Pat. No. 8,905,811.

(60) Provisional application No. 61/597,513, filed on Feb. 10, 2012.

(51) Int. Cl.

| | |
|---|---|
| ***A63H 27/00*** | (2006.01) |
| ***A63H 33/18*** | (2006.01) |
| ***A63B 59/00*** | (2015.01) |

(52) U.S. Cl.
CPC ..... *A63H 33/18* (2013.01); *A63B 59/00* (2013.01); *A63H 27/00* (2013.01)

(58) Field of Classification Search
CPC ..... A63H 33/18; A63H 27/00; A63B 59/00
USPC ..... 446/46, 47, 48, 219, 487, 485, 153
See application file for complete search history.

(56) References Cited

U.S. PATENT DOCUMENTS

| | | | | |
|---|---|---|---|---|
| 8,905,811 | B2 * | 12/2014 | Williams | 446/46 |
| 2011/0130229 | A1 * | 6/2011 | Williams | 473/505 |
| 2013/0210313 | A1 * | 8/2013 | Williams | 446/46 |

* cited by examiner

*Primary Examiner* — Vishu Mendiratta
(74) *Attorney, Agent, or Firm* — Kane Kessler, P.C.; Barry E. Negrin; Paul E. Szabo

(57) ABSTRACT

A flying disk toy includes an annular inner ring centered on the axis and connected with an outer ring, and a flexible material secured to the inner ring and creating a trampoline surface. The inner ring is detachably received in a groove in the outer ring. The groove has an undercut, and the inner ring has a portion including relatively movable flanges that engage in the undercut in the groove to resist removal of the inner ring from the groove.

13 Claims, 5 Drawing Sheets

FLYING DISK WITH REMOVABLE TRAMPOLINE PORTION

RELATED APPLICATION

Domestic priority is claimed from U.S. Provisional Application No. 61/597,513, filed Feb. 10, 2012, the disclosure of which is hereby incorporated by reference.

BACKGROUND OF THE INVENTION

This invention relates to a racquet-like flying disk toy. In particular, this invention relates to a racquet-like flying disk toy with a trampoline center portion removably connected in an outer ring. Such products and how they are used are known in the art, for example, from U.S. Pat. No. 8,241,153, the disclosure of which is hereby incorporated by reference. The center portion of the toy shown in U.S. Pat. No. 8,241,153 can, at times, inadvertently come out of the outer ring. A toy of the present invention is less susceptible to such an occurrence.

SUMMARY OF THE INVENTION

One embodiment of the present invention is a sports activity device adapted to be both a flying disc and a racquet-like apparatus. The device includes an annular outer ring having an outer surface and an annular groove in the outer surface. An annular inner ring is detachably connectable with the outer ring and defines a central opening in the inner ring. A flexible material is secured to the inner ring and extends across the central opening of the inner ring and creates a trampoline surface that stretches across the central opening of the inner ring. The inner ring is received in the groove of the outer ring, to detachably connect the inner ring and thereby the flexible material to the outer ring. The groove has an irregular configuration defined by a series of side surfaces intersecting with each other and with the outer surface of the outer ring. The inner ring has an irregular configuration including a plurality of relatively movable flanges that engage at least one of the side surfaces of the groove to resist removal of the inner from the groove thereby to resist disconnection of the inner ring from the outer ring.

In that embodiment, the groove may have an outer portion and an inner, undercut portion that is axially offset from the outer portion of the groove.

The relatively movable portions of the inner ring may include a side portion, an upper flange, and a lower flange, the upper flange extending inward and downward from the upper end of the side portion, and the lower flange extending inward and upward from the lower end of the side portion.

The groove may include an outer portion and an inner, undercut portion that is axially offset from the outer portion of the groove. A plurality of the relatively movable portions of the inner ring are resiliently insertable into the undercut and are compressed together in response to a removing force that is applied to separate the inner ring from the outer ring.

In various embodiments, the outer ring may be made from EVA foam or from TPR foam.

In another embodiment, the outer ring has a toroidal configuration centered on an axis, and the outer surface of the ring includes an upper side surface, an outer side surface that is farthest from the axis, a lower side surface, and an inner side surface that is closest to the axis. The groove extends downward from the upper side surface of the outer ring and is defined by a series of interconnected surfaces including a generally flat first surface that extends downward from the upper side surface of the outer ring and that is closest to the axis; a generally flat second surface that is lowermost and that extends axially outward from the first surface; a curved third surface that extends upward and axially inward from the second surface; and a generally flat fourth surface that extends from the third surface upward to the upper side surface of the ring. The groove as thus formed includes an outer portion that is located above the third surface, and an undercut portion that is located below the fourth surface and axially offset from the outer portion of the groove.

The relatively movable portions of the inner ring may include a side portion, an upper flange, and a lower flange, the upper flange extending inward and downward from the upper end of the side portion and terminating in an upper flange edge, and the lower flange extending inward and upward from the lower end of the side portion and terminating in a lower flange edge. The side portion of the inner ring may engage the first surface of the groove, and the upper flange and the lower flange of the inner ring may resiliently engage the third surface of the groove in the undercut portion of the groove to resist movement of the inner ring of the groove. The upper flange edge and the lower flange edge may engage the fourth surface of the groove during insertion of the inner ring into the groove and thereafter resiliently engage in the undercut portion of the groove.

Another embodiment of the invention is a sports activity device adapted to be both a flying disc and a racquet-like apparatus. The device includes an annular outer ring centered on an axis and having an outer surface and an annular groove in the outer surface. An annular inner ring centered on the axis is detachably connected with the outer ring and defines a central opening in the inner ring. A flexible material is secured to the inner ring and extends across the central opening of the inner ring and creates a trampoline surface that stretches across the central opening of the inner ring. The inner ring is received in the groove of the outer ring to detachably connect the inner ring and thereby the flexible material to the outer ring. The groove includes an undercut in the material of the outer ring that is located on the axially outer side of the groove. The inner ring includes a portion that engages in the undercut to resist removal of the inner ring from the groove thereby to resist removal of the inner ring from the outer ring.

In that embodiment, the inner ring may include a plurality of relatively movable flanges that fit into the undercut and that are resiliently deformed upon assembly of the outer ring with the inner ring to resist removal of the inner ring from the groove. The outer ring may be made from EVA foam of from TPR foam.

A further embodiment of the invention is a flying disk toy including an annular outer ring centered on an axis; an annular inner ring connected with the outer ring; and a flexible material secured to the inner ring and creating a trampoline surface. The inner ring is detachably received in a groove in the outer ring, the groove having an undercut, and the inner ring having relatively movable flanges that engage in the undercut in the groove to resist removal of the inner ring from the groove.

DETAILED DESCRIPTION

Description will now be given with reference to the attached FIGS. 1-7. These figures are exemplary in nature and in no way serve to limit the scope of the invention, which is defined by the claims appearing hereinbelow.

Figure 1:
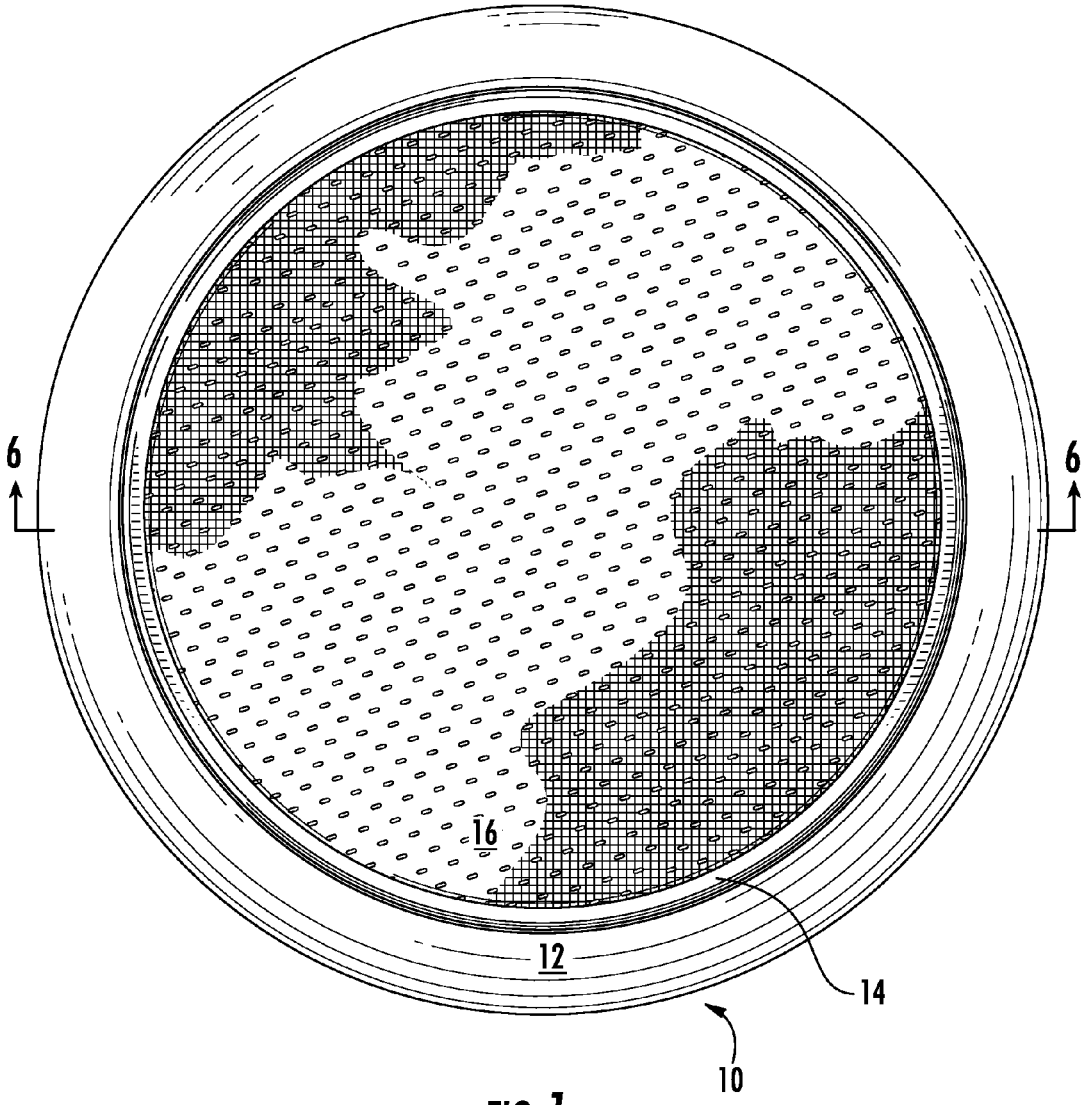
FIG. 1 is a top plan view of a flying disk that is an embodiment of the invention.
Figure 2:
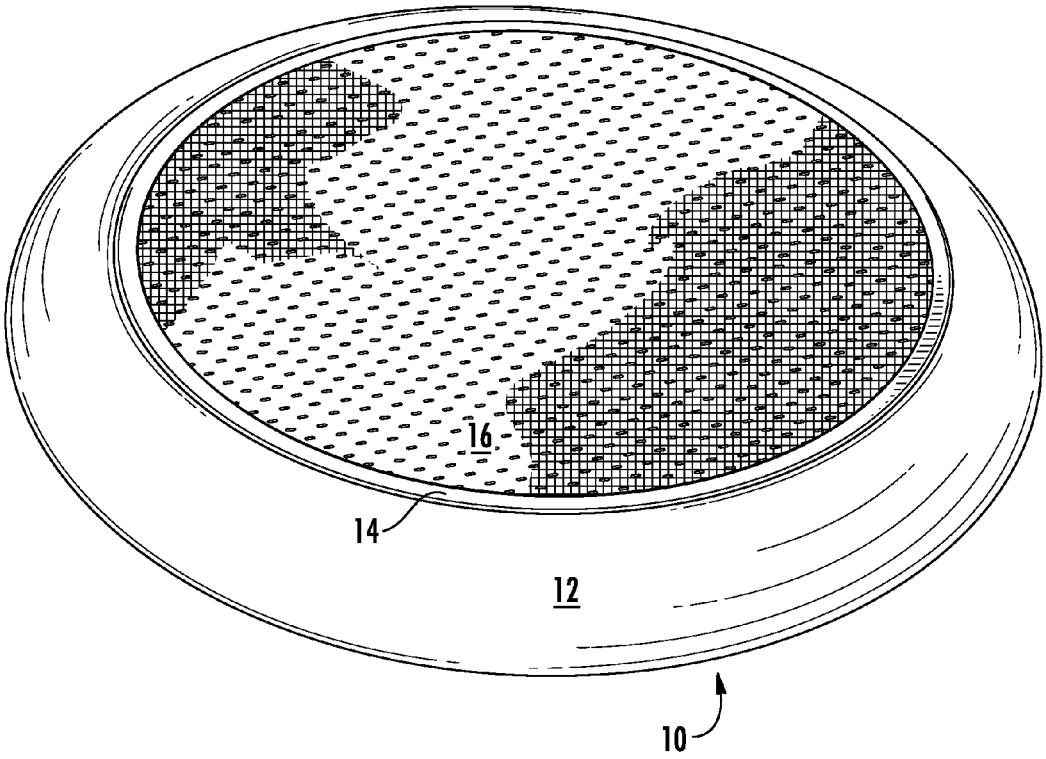
FIG. 2 is a top perspective view of the flying disk of FIG. 1.
Figure 3:
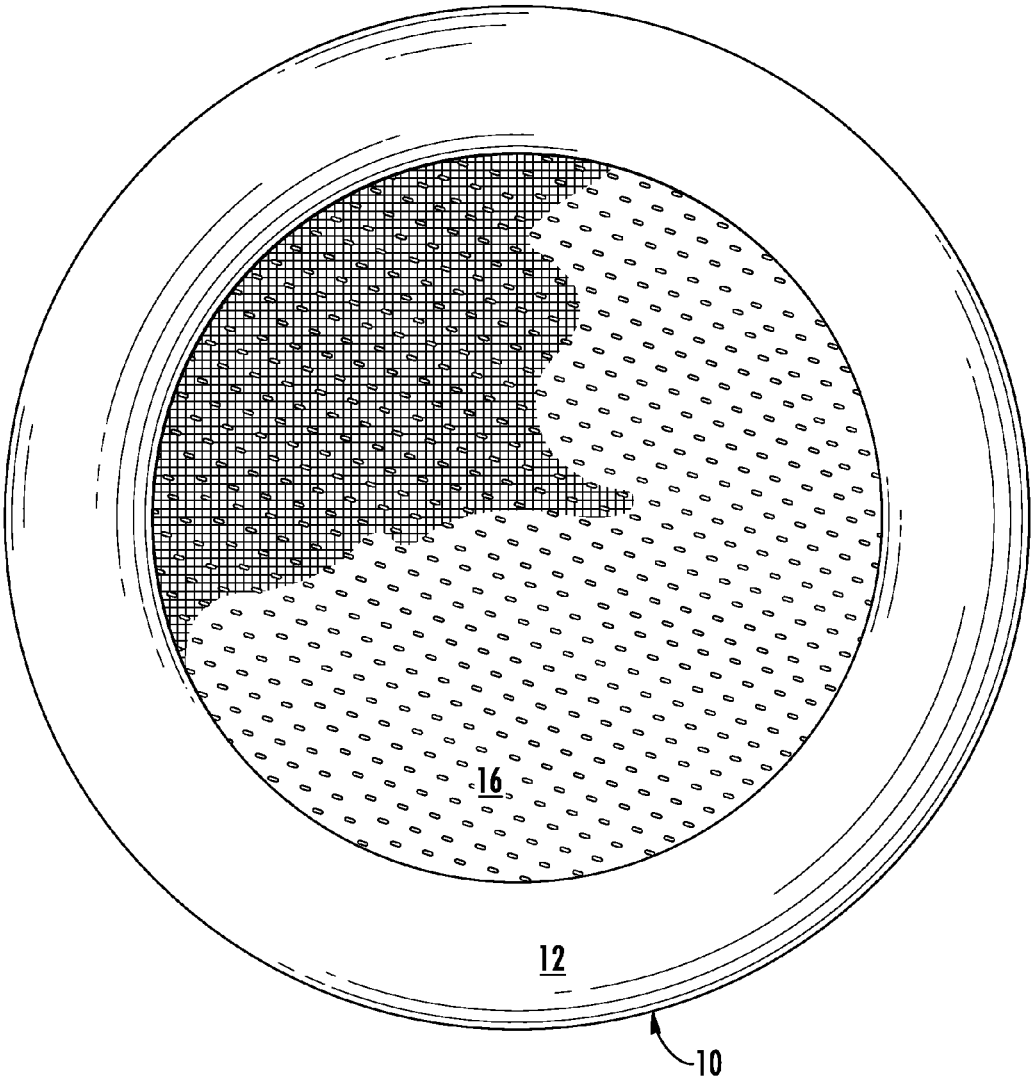
FIG. 3 is a bottom plan view of the flying disk of FIG. 1.

This invention relates to a racquet-like flying disk toy. In particular, this invention relates to a racquet-like flying disk toy with a removable trampoline center portion. The invention is applicable to disk toys of different constructions. As representative of the invention, FIG. 1 illustrates a disk toy 10 that is one embodiment of the invention.

Figure 4:
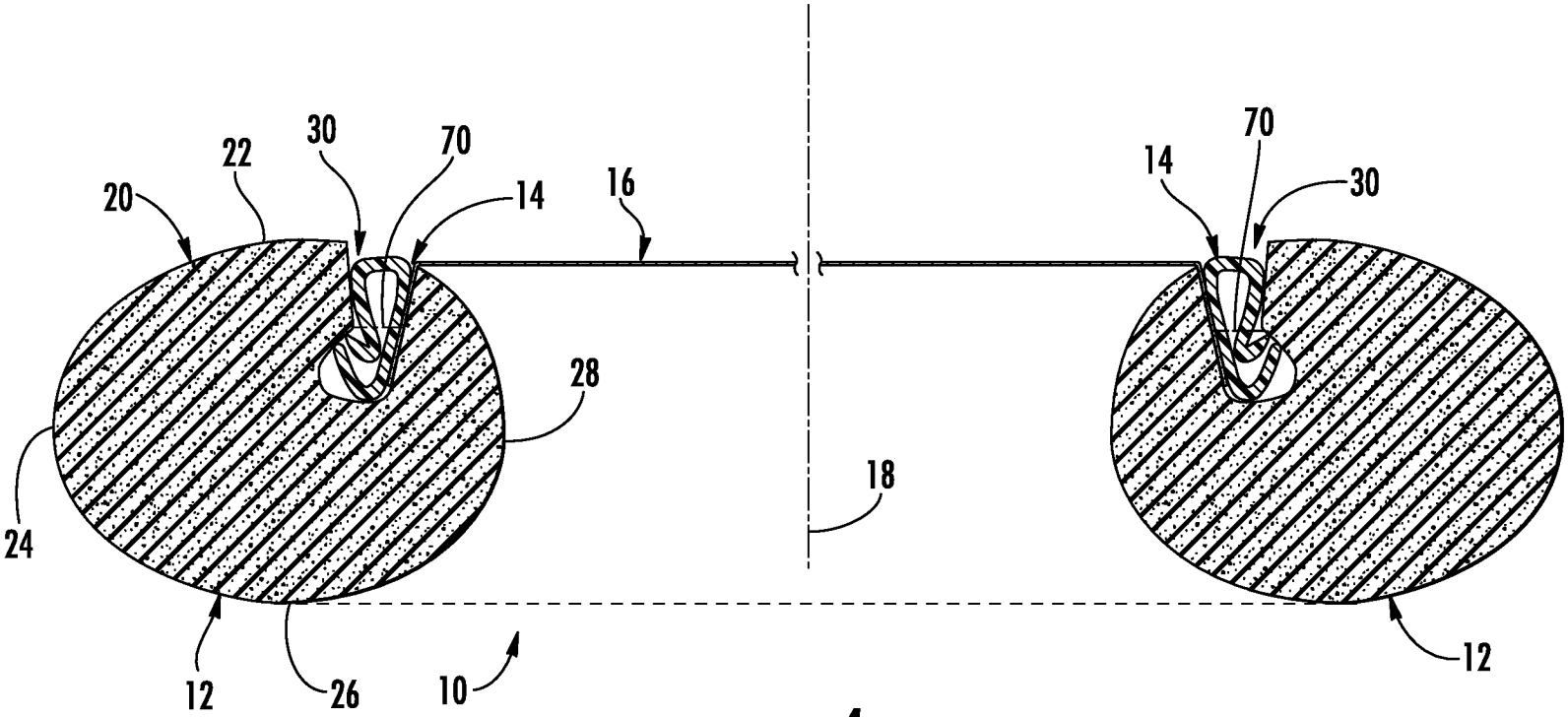
FIG. 4 is a radial sectional view of the flying disk of FIG. 1.
Figure 5:
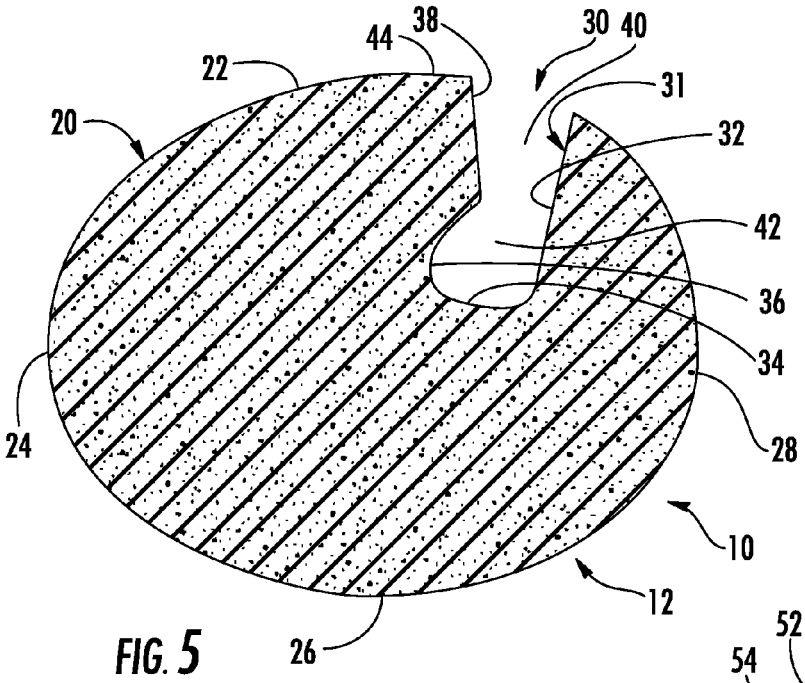
FIG. 5 is a sectional view of an outer ring that forms part of the flying disk of FIG. 1.
Figure 6:
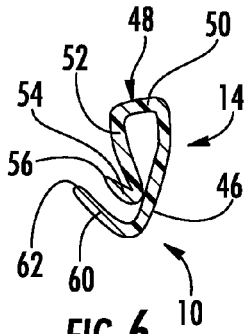
FIG. 6 is a sectional view of an inner ring that forms part of the flying disk of FIG. 1.
Figure 7:
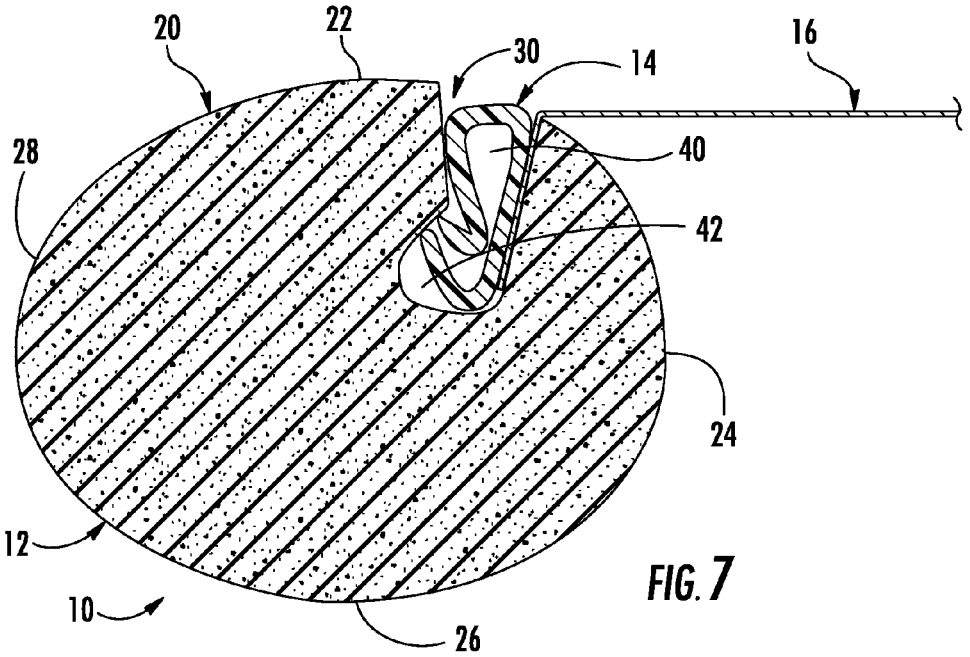
FIG. 7 is a sectional view showing the inner ring of FIG. 6 assembled with the outer ring of FIG. 5.

The disk 10 includes generally three pieces: an outer ring 12, an inner ring 14, and a membrane 16. The outer ring 12 is preferably molded as one piece from EVA foam in the form of a toroid, centered on an axis 18 (FIG. 4). Other materials can be used; one alternative material is TPR foam (thermoplastic rubber foam). Specifically, the outer ring is initially formed in a mold with about 40% of its ultimate volume, then when released from the mold, expands to its final volume and configuration.

The outer ring 12 (FIG. 4) has a generally ovoid cross-sectional configuration with an exterior surface 20. The exterior surface 20 can be considered to include an upper side surface 22, an outer side surface 24 (farthest from the axis 18), a lower side surface 26, and an inner side surface 28 (closest to the axis 18). (The terms upper and lower, as used herein, refer to the toy 10 when in an orientation as shown in the drawings. Clearly, if the toy 10 is inverted, the surfaces are reversed. The terms upper and lower thus are not limiting, but are rather used only for convenience when referring to the drawings.)

An annular groove 30 (FIG. 5) is formed in the solid material of the outer ring 12. The groove 30 extends downward from the upper side surface 22, closer to the inner side surface 28 than to the outer side surface 24.

The groove 30 has an irregular configuration defined by an interior surface 31 on the outer ring 12. The interior surface 31 is constituted as a series of interconnected individual, annular surfaces that include a generally flat first surface 32 extending downward from the upper side surface 22. The first surface 32 is radially innermost, that is, closest to the axis 18 as seen in cross section. A generally flat second surface 34 is lowermost in the groove 30 and extends radially outward from the first surface 32. A curved third surface 36 extends upward and radially inward from the second surface 34. A generally flat fourth surface 38 extends upward from the third surface 36 and intersects the upper side surface 22 of the outer ring 12.

The groove 30 as thus formed includes an outer portion 40 that is located above the third surface 36. The groove 30 also includes an inner, undercut portion 42 that is located below the fourth surface 38. The term "undercut" is used because the outer ring 12 includes solid material as indicated at 44 that is located radially inward of the third surface 36. The undercut portion 42 of the groove 30 is formed during the molding process described above.

The inner ring 14 is an extrusion formed from a single linear piece having a length approximately equal to the circumference of the inner ring 14, with the two ends being joined by a pin (not shown) or other means. Preferred materials include polypropylene and polyethylene. The inner ring 14 has an irregular configuration (for example, non-circular, non-ovoid, non-rectangular) including a plurality of relatively movable flanges that, as described below, engage the interior surface 31 of the groove to resist removal of the inner ring from the groove thereby to resist removal of the inner ring from the outer ring 12.

Specifically, the inner ring 14 (FIG. 6) includes a side portion 46 that is radially outermost on the inner ring. The side portion 46 extends generally parallel to the axis 18. The inner ring 14 also includes an upper flange 48. The upper flange 48 has a first portion 50 that extends inward and slightly downward from the upper end of the side portion 46. A second portion 52 of the upper flange 48 extends from the first portion 50 and curls back toward the side portion 46 and abuts the side portion 46. A third portion 54 of the upper flange 48 extends from the second portion 52 in a direction away from the side portion 46 and terminates in an upper flange edge 56 that is preferably relatively sharp as illustrated.

The inner ring 12 also includes a lower flange 60 that extends inward and upward from the lower end of the side portion 46 and that terminates in a lower flange edge 62 that may be relatively sharp as illustrated. The two flanges 48 and 60 of the inner ring 12 are resiliently movable relative to each other and to the side portion 46 of the inner ring.

The membrane 16 (FIG. 4) in the illustrated embodiment is an elastic fabric and thus serves as a trampoline member. Other fabrics or membranes could, alternatively, be used. The membrane 16 is sewn to the inner ring 14 by stitching 70 extending through the upper flange 46 and the side portion 46 of the inner ring. Other forms of attachment could be used.

The configuration of the inner ring 14 and the configuration of the groove 30 are selected so that the inner ring 14 can be securely, but removably, fitted into the outer ring 12. Specifically, to assemble the two pieces, the inner ring 14 is moved into the groove 30 (downward as viewed in FIGS. 4 and 7). The side portion 46 of the inner ring 14 engages and slides downward along the first surface 32 of the groove 30.

The lower flange 60 of the inner ring 14 engages the fourth surface 38 of the groove 30 and is bent back toward the inner ring side portion 46. The lower flange 60 moves into the undercut portion 42 of the groove 30. The resilience of the lower flange 60 causes the lower flange to snap or bend back out away from the inner ring side portion 46. The lower flange edge 62 presses against and digs into the third surface 36 of the groove 30.

The upper flange 48 of the inner ring 14, as it enters the groove 30, engages the fourth surface 38 and is compressed or bent back toward and against the inner ring side portion 46. The third portion 54 of the upper flange 48 moves into the undercut portion 42 of the groove 30. The resilience of the upper flange 48 causes the upper flange edge 56 to press against and dig into the third surface 36 of the groove 30. Simultaneously, the resilience of the upper flange 48 causes the second portion 52 of the upper flange to press against the fourth surface 38 of the groove 30

The engagement of the two flanges 60 and 62 with the third surface 36 of the groove 30 resists movement of the inner ring 14 out of the groove (upward as viewed in FIGS. 4 and 7), enough to keep the inner ring and thus the membrane secured to the outer ring 12 when the disk 10 is in use. The portions of the inner ring 14 that are in the undercut portion 42 of the groove 30, which resiliently insertable into the undercut, are compressed together in response to any removing force that is applied to separate the inner ring from the outer ring.

When the disk 10 is being used in a racquet-like manner, e.g., a ball or similar object is striking off of the membrane 16, the force of the impact of the ball or other object against the membrane is insufficient to dislodge the inner ring 14 from the outer ring 12. With the use of sufficient force, the inner ring 14 can be pried out of the groove 30, to remove the membrane and inner ring from the outer ring 12, thereby to enable those two pieces to be used separately from each other. As a result, a replacement membrane 14 can be selectively attached to an inner ring 14 for purposes of repair, or desired color change, or desired change of logo, or for other reasons.

The invention is not limited to the above description or the illustrated embodiment. Rather, the scope of the invention is defined by the claims appearing hereinbelow and includes any equivalents thereof as would be appreciated by one of ordinary skill in the art.

The invention claimed is:

1. A sports activity device adapted to be both a flying disc and a racquet-like apparatus, comprising:

an annular outer ring having an outer surface and an annular groove in the outer surface;

an annular inner ring detachably connectable with the outer ring and defining a central opening in the inner ring; and a flexible material secured to the inner ring and extending across the central opening of the inner ring and creating a trampoline surface that stretches across the central opening of the inner ring;

the inner ring being received in the groove of the outer ring, to detachably connect the inner ring and thereby the flexible material to the outer ring;

the groove having an irregular configuration defined by a series of side surfaces intersecting with each other and with the outer surface of the outer ring;

the inner ring having an irregular configuration including a plurality of relatively movable flanges;

the flanges having a first position relative to each other when in a free state outside the groove and, when in the first position, being spaced apart from each other by a first distance;

the flanges having a second position relative to each other when they are partially but not fully inserted into the groove and, when in the second position, being spaced apart from each other by a second distance that is less than the first distance;

the flanges having a third position relative to each other when they are fully inserted into the groove and, when in the third position, being spaced apart from each other by a third distance that is greater than the second distance;

the flanges when fully inserted in the groove and when in the third position engaging at least one of the side surfaces of the groove and resisting removal of the inner ring from the groove.

2. A sports activity device as set forth in claim 1 wherein the groove has a width that is greater than the second distance but less than the first distance and less than the third distance, whereby the flanges are resiliently compressed toward each other in response to a removing force that is applied to separate the inner ring from the outer ring.

3. A sports activity device as set forth in claim 1 wherein:

a first portion of the groove extends axially inward from the outer surface of the ring and has a first width;

a second portion of the groove extends axially inward from the first portion and has a second width that is greater than the first width, being wider in a direction radially outward of the first portion of the groove, the second portion of the groove terminating on a bottom surface of the groove; and the inner ring is received in the groove of the outer ring, with a first portion of the inner ring being disposed in the first portion of the groove and a second portion of the inner ring being disposed in the second portion of the groove, to detachably connect the inner ring and thereby the flexible material to the outer ring.

4. A sports activity device as set forth in claim 3 wherein the second portion of the inner ring comprises end portions of two of the plurality of relatively movable flanges, the end portions being disposed in the second portion of the groove.

5. A sports activity device as set forth in claim 3 wherein the outer ring has an annular edge defined at the location where the radially outward side of the first portion of the groove extends axially inward from the outer surface of the outer ring, and the flexible material extends across the annular edge and into the groove.

6. A sports activity device as set forth in claim 3 wherein the first portion of the groove tapers as it extends from the outer surface of the outer ring to the second portion of the groove.

7. A sports activity device adapted to be both a flying disc and a racquet-like apparatus, comprising:

an annular outer ring centered on an axis and having an outer surface including an upper side surface of the outer ring, the outer ring also having internal surfaces defining an annular groove in the outer surface, the groove being centered on the axis and extending axially downward from the upper side surface of the outer ring;

an annular inner ring centered on the axis and detachably connected with the outer ring and defining a central opening in the inner ring; and a flexible material secured to the inner ring and extending across the central opening of the inner ring and creating a trampoline surface that stretches across the central opening of the inner ring;

the inner ring being received in the groove of the outer ring, to detachably connect the inner ring and thereby the flexible material to the outer ring;

the groove including an undercut, the internal surfaces of the outer ring including diverging surfaces that define the undercut in the material of the outer ring that is located on the radially outer side of the groove, the undercut being located a substantially constant distance from the upper side surface of the outer ring at all points circumferentially around the axis; and the inner ring including a portion that engages in the undercut and resists removal of the inner ring from the groove.

8. A sports activity device as set forth in claim 7 wherein the portion of the inner ring that engages in the undercut includes a plurality of relatively movable flanges that fit into the undercut and that are resiliently deformed upon assembly of the outer ring with the inner ring to resist removal of the inner ring from the groove.

9. A sports activity device as set forth in claim 8 wherein the undercut is defined partially by a radially outer surface that is located axially below solid material of the outer ring.

10. A sports activity device as set forth in claim 8 wherein:

a first portion of the groove extends axially inward from the outer surface of the ring and has a first width;

a second portion of the groove extends axially inward from the first portion and has a second width that is greater than the first width, being wider in a direction radially outward of the first portion of the groove, the second portion of the groove terminating on a bottom surface of the groove; and a first portion of the inner ring is disposed in the first portion of the groove and a second portion of the inner ring is disposed in the second portion of the groove, to detachably connect the inner ring and thereby the flexible material to the outer ring.

11. A sports activity device as set forth in claim 10, wherein the second portion of the inner ring comprises end portions of two of the plurality of relatively movable flanges, the end portions being disposed in the second portion of the groove.

12. A sports activity device as set forth in claim 10 wherein the first portion of the groove tapers as it extends from the outer surface of the outer ring to the second portion of the groove.

13. A sports activity device as set forth in claim 10 wherein the outer ring has an annular edge defined at the location where the radially outward side of the first portion of the groove extends axially inward from the outer surface of the outer ring, and the flexible material extends across the annular edge and into the groove.

* * * * *